US010186278B2

(12) United States Patent
Salishev

(10) Patent No.: US 10,186,278 B2
(45) Date of Patent: Jan. 22, 2019

(54) MICROPHONE ARRAY NOISE SUPPRESSION USING NOISE FIELD ISOTROPY ESTIMATION

(71) Applicant: INTEL CORPORATION, Santa Clara, CA (US)

(72) Inventor: Sergey I. Salishev, Saint-Petersburg (RU)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/545,294

(22) PCT Filed: Apr. 29, 2015

(86) PCT No.: PCT/IB2015/000917

§ 371 (c)(1),
(2) Date: Jul. 20, 2017

(87) PCT Pub. No.: WO2016/174491

PCT Pub. Date: Nov. 3, 2016

(65) Prior Publication Data

US 2018/0012617 A1 Jan. 11, 2018

(51) Int. Cl.

| | |
|---|---|
| ***G10L 21/0232*** | (2013.01) |
| ***G10L 25/21*** | (2013.01) |
| ***H04R 1/04*** | (2006.01) |
| ***H04R 1/40*** | (2006.01) |
| ***H04R 3/00*** | (2006.01) |

(Continued)

(52) U.S. Cl.

CPC ..... *G10L 21/0232* (2013.01); *G10L 21/0216* (2013.01); *G10L 25/21* (2013.01); *H04R 1/04* (2013.01); *H04R 1/406* (2013.01); *H04R 3/005* (2013.01); *G10L 2021/02166* (2013.01); *H04R 1/028* (2013.01); *H04R 1/1008* (2013.01);

(Continued)

(58) Field of Classification Search

CPC ..... G10L 21/0232; G10L 25/21; G10L 2021/02166; G10L 21/0216; H04R 1/04; H04R 1/406; H04R 3/005; H04R 3/04; H04R 2201/403; H04R 2499/11; H04R 1/028; H04R 1/1008; H04R 1/345

USPC ..... 381/92

See application file for complete search history.

(56) References Cited

U.S. PATENT DOCUMENTS

2012/0093333 A1 4/2012 Hu et al.

FOREIGN PATENT DOCUMENTS

JP 2007-147732 A 6/2007

OTHER PUBLICATIONS

European Patent Office, International Search Report and Written Opinion for International Patent Application No. PCT/IB2015/000917, dated Feb. 16, 2016, 17 pages.

(Continued)

*Primary Examiner* — Vivian Chin
*Assistant Examiner* — Douglas Suthers
(74) *Attorney, Agent, or Firm* — Womble Bond Dickinson (US) LLP

(57) ABSTRACT

Noise is suppressed from a microphone array by estimating a noise field isotropy. In some examples audio is received from a plurality of microphones. A power spectral density of a beamformer output is determined and a power spectral density of microphone noise differences is determined. A noise power spectral density is determined using a transfer function and the noise power spectral density is applied to (Continued)

the beamformer output power spectral density to produce a power spectral density output of the received audio with reduced noise.

20 Claims, 5 Drawing Sheets

(51) Int. Cl.

| | |
|---|---|
| ***G10L 21/0216*** | (2013.01) |
| *H04R 1/02* | (2006.01) |
| *H04R 1/10* | (2006.01) |
| *H04R 1/34* | (2006.01) |

(52) U.S. Cl.
CPC ..... *H04R 1/345* (2013.01); *H04R 2201/403* (2013.01); *H04R 2499/11* (2013.01)

(56) References Cited

OTHER PUBLICATIONS

Zelinski, A Microphone Array With Adaptive Post-Filtering for Noise Reduction in Reverberant Rooms, Proc. ICASSP-88, 1988, pp. 2578-2581.
Shimizu, Isotropic Noise Suppression in the Power Spectrum Domain by Symmetric Microphone Arrays, Oct. 2007, pp. 54-57, IEEE Workshop on Applications of Signal to Audio and Acoustics.
McCowan, et al, Microphone Array Post-Filter Based on Noise Field Coherence, IEEET-SAP, 2003, pp. 709-716.
Lefkimmiatis, et al., A Generalized Estimation Approach for Linear and Nonlinear Microphone Array Post-Filters, Speech Communication, Jul. 2007, pp. 657-666.
International Search Report and Written Opinion received for PCT Patent Application No. PCT/IB2015/000917, dated Feb. 16, 2016, 9 pages.
International Preliminary Report on Patentability received for PCT Patent Application No. PCT/IB2015/000917, dated Nov. 9, 2017, 8 pages.

MICROPHONE ARRAY NOISE SUPPRESSION USING NOISE FIELD ISOTROPY ESTIMATION

CROSS-REFERENCE TO RELATED APPLICATION

This patent application is a U.S. National Phase Application under 35 U.S.C. § 371 of International Application No. PCT/IB2015/000917, filed Apr. 29, 2015, entitled MICROPHONE ARRAY NOISE SUPPRESSION USING NOISE FIELD ISOTROPY ESTIMATION.

FIELD

The present description relates to the field of audio processing and in particular to enhancing audio using signals from multiple microphones.

BACKGROUND

Many different devices offer microphones for a variety of different purposes. The microphones may be used to receive speech from a user to be sent to users of other devices. The microphones may be used to record voice memoranda for local or remote storage and later retrieval. The microphones may be used for voice commands to the device or to a remote system or the microphones may be used to record ambient audio. Many devices also offer audio recording and, together with a camera, offer video recording. These devices range from portable game consoles to smartphones to audio recorders to video cameras, to wearables, etc.

When the ambient environment, other speakers, wind, and other noises impact a microphone, a noise is created which may impair, overwhelm, or render unintelligible the rest of the audio signal. A sound recording may be rendered unpleasant and speech may not be recognizable for another person or an automated speech recognition system. While materials and structures have been developed to block noise, these typically require bulky or large structures that are not suitable for small devices and wearables. There are also software-based noise reduction systems that use complicated algorithms to isolate a wide range of different noises from speech or other intentional sounds and then reduce or cancel the noise.

BRIEF DESCRIPTION OF THE DRAWINGS

Embodiments are illustrated by way of example, and not by way of limitation, in the figures of the accompanying drawings in which like reference numerals refer to similar elements.

DETAILED DESCRIPTION

Figure 1:
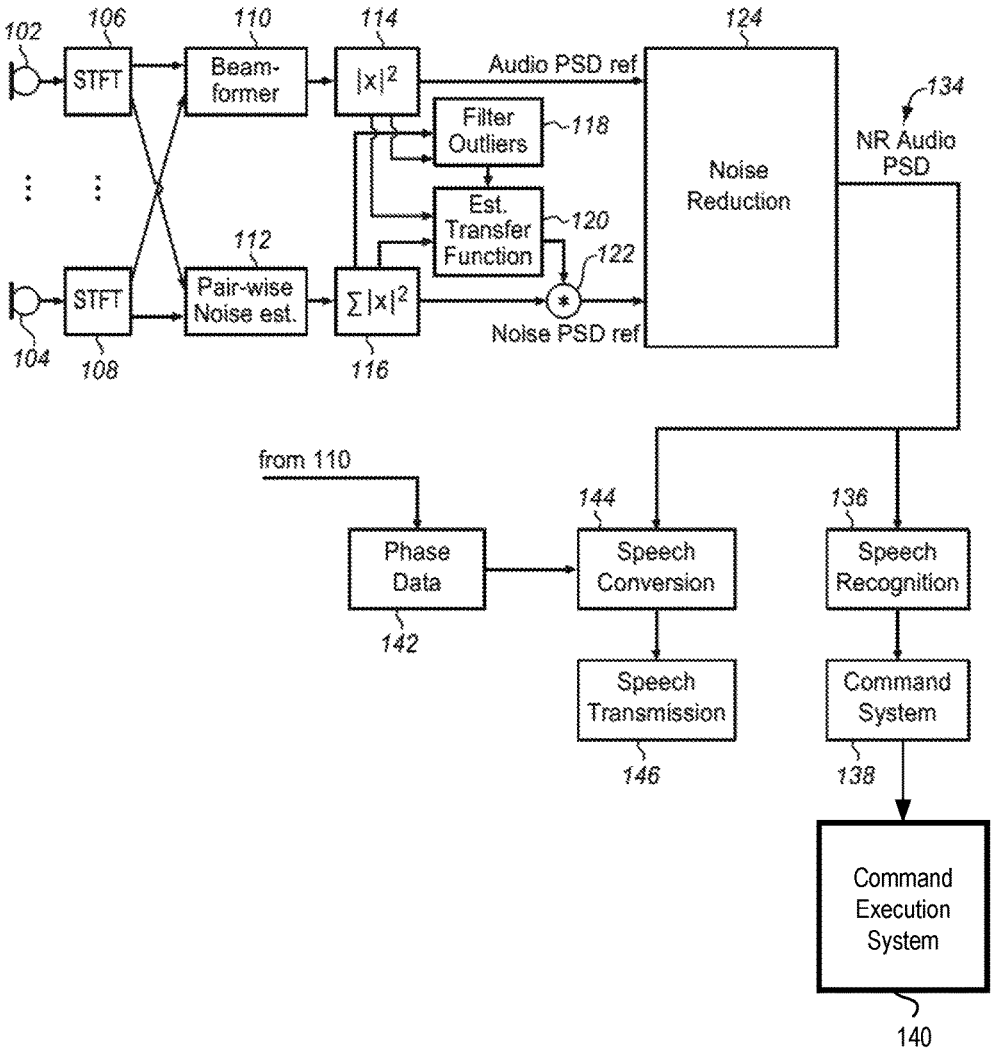
FIG. 1 is a block diagram of a speech enhancement system according to an embodiment.

A sound field isotropy model describes a correlation between sound field phases in different space locations in the assumption that Power Spectral Density (PSD) of the field is equal across space. As described herein this correlation in a microphone array may be estimated as the audio is received. This estimation provides for improvements in noise suppression for speech and other types of audio signals using microphone array beamforming.

In many environments, reverberation in a space surrounding noise sources creates correlations between noise signals as they are received at different microphones of the array. This leads to errors in the beamformer output noise estimates. A noise field isotropy model is used in many systems. The model is a compromise between an uncorrelated noise model which is usually incorrect and an accurate geometrical reverberation model which is usually impossible to determine due to the lack of data and the lack of time for real time systems.

The correlation between microphones may be used in post-filter techniques for noise suppression and may have a substantial impact on the accuracy of voice recognition for closely spaced microphones. The accuracy may be much better than for post-filter models that assume that the noise is uncorrelated. As a result, better accuracy may be obtained when some type of noise field isotropy is assumed when post-filtering audio from multiple microphones. Two common isotropy models are spherical isotropy and cylindrical isotropy. Traditional spherical isotropy considers each point on an infinite sphere as a source of an uncorrelated sound wave. Cylindrical isotropy is similar but uses an infinite cylinder (or plane) instead of a sphere. Spherical isotropy is intended for use as a reverberation model in indoor environments and cylindrical isotropy is intended for use in outdoor environments.

When a predefined isotropy model is used there is always a chance that the wrong model will be selected. When the wrong isotropy model is selected, then the beamformer output noise estimation will be incorrect. The estimation results may be worse than if no correlation is assumed. In addition, common simple models may not take into consideration sound wave diffraction by the body of the device enclosing the microphones and perhaps the body of a user. Such models may not take into account different microphone placements and materials as well as different and less common audio environments.

For more accurate beamformer output noise estimation, the noise field phase correlation between microphones may be estimated directly from observed data. Such a system adapts to a reverberation environment that changes over time. However, non-stationary signal sources may provide an output spectrum that changes much faster than the correlation of the signals between microphones. In addition, determining the correlation between each pair of microphones in a large array requires much more computational resources. In addition, it is difficult to estimate moving averages because the variance in the correlation for a time interval is similar in scale to the mean value of the correlation. Finally some filtering may be required to address dominant direct noise signals.

As described herein, a PSD (Power Spectral Density) of the noise in the output of a beamformer multiplied by an unknown transfer function may be estimated using a sum of pair-wise microphone PSD differences. The beamformer output noise PSD may be calculated by multiplying an inverse transfer function by the sum of pair-wise microphone PSD differences. This is more accurate than using an a priori choice of pair-wise microphone correlation functions. Using the transfer function, a single vector coefficient is enough for the whole microphone array. The transfer function may be calculated in real time by estimating a running median of logarithms of per frame transfer functions.

The log transform makes correlation scale differences between frequencies more level. The median works well because it is robust to outliers and is invariant to log transforms. Better results may be obtained by filtering out frames with high positive or negative overall correlation. These frames are typically dominated by direct signals which should be preserved by the noise reduction.

A single aggregated transfer function greatly reduces the number of multiplication computations for noise estimations. Compared to pair-wise correlations, the multiplications are reduced by a factor n(n−1)/2, where n is the number of microphones. As a result, the transfer function may easily be calculated in real time as the audio is received even for large microphone arrays. This allows the noise estimation to be used during conversations and recordings without significant lag.

A general context for speech enhancement is shown in FIG. 1. FIG. 1 is a block diagram of a noise reduction or speech enhancement system as described herein. The system has a microphone array. Two microphones 102, 104 of the array are shown but there may be more, depending on the particular implementation. Each microphone is coupled to an STFT (Short Term Fourier Transform) block 106, 108. The analog audio, such as speech, is received and sampled at the microphone. The microphone generates a stream of samples to the STFT block. The STFT blocks convert the time domain sample streams to frequency domain frames of samples. The sampling rate and frame size may be adapted to suit any desired accuracy and complexity. The STFT blocks determine a frame $\{X_i\}$ for each microphone sample stream i=1 . . . n, where n is a number of microphones in the array.

All of the frames determined by the STFT blocks are sent from the STFT blocks to a beamformer in the frequency domain 110. In this example, the beamforming is assumed to be near-field. As a result, the voice is not reverberated. The beamforming may be modified to suit different environments, depending on the particular implementation.

In the examples provided herein, the beam is assumed to be fixed. Beamsteering may be added, depending on the particular implementation. In the examples provided herein, voice and interference are assumed to be uncorrelated.

All of the frames are also sent from the STFT blocks to a pair-wise noise estimation block 112. The noise is assumed to have an unknown spatial correlation $\Gamma_{ij}$ in the frequency domain between each pair of microphones.

For STFT frame t and frequency bin ω the following model may be used in this example. This model may be modified to suit different implementations and systems:

$$X_i=h_iS+N_i \quad \text{Eq. 1}$$

$$E(S\,N_i)=0 \quad \text{Eq. 2}$$

$$E(N_iN_i)=|N|^2 \quad \text{Eq. 3}$$

$$E(N_iN_j)=\Gamma_{ij}|N|^2, i\neq j \quad \text{Eq. 4}$$

Where $X_i$ is the STFT frame t of noise from microphone i from the corresponding STFT block at frequency ω. $h_i \in \mathbb{C}$ is the phase/amplitude shift of the speech signal in the microphone i at frequency ω and is used as a weighting factor. S is an idealized clean STFT frame t of the voice signal at frequency ω. $N_i$ is an STFT frame t of noise from the microphone i at frequency ω. E is the noise estimate.

Returning to FIG. 1, the beamformer output Y may be determined by block 110 in a variety of different ways. In one example, a weighted sum is taken over all microphones from 1 to n of each STFT frame using the weight $w_i$ determined from $h_i$ as follows:

$$w_i=(nh_i)^{-1} \quad \text{Eq. 5}$$

$$Y=\Sigma_{i=1}^{n}w_iX_i \quad \text{Eq. 6}$$

$$Y=S+V \quad \text{Eq. 7}$$

The microphone array may be used for a hands-free command system that is able to use directional discrimination. The beamformer exploits the directional discrimination of the array allowing for a reduction of undesired noise sources and allowing a speech source to be tracked. The beamformer output is later enhanced by applying a post-filter as described in more detail below.

At block 112 pair-wise noise estimates $V_{ij}$ are determined. The pair-wise estimates may be determined using weighted differences of the STFT frames for each pair of microphones or in any other suitable way. If there are two microphones, then there is only one pair for each frame. The noise estimate is a weighted difference between the STFT noise frame from each microphone.

$$V_{ij}=w_iX_i-w_jX_j \quad \text{Eq. 8}$$

At block 114 the power spectral density (PSD) $|Y|^2$ is determined for the beamformer values and at block 116, the PSD $|P|^2$ is determined for the pair-wise noise estimates.

$$|P|^2=\Sigma_{i=1}^{n-1}\Sigma_{j=i+1}^{n}|V_{ij}|^2 \quad \text{Eq. 9}$$

At block 118, having calculated the estimates, the outliers are removed. These outliers correspond to pairs for which the noise has high correlation between the microphones. Such a situation is caused by a direct signal to the microphone array either from a desired speech source or from the noise source. This process receives the PSD results for both the beamformer values and the pair-wise noise estimates.

The outliers may be identified by calculating T an average of the log transfer function over the frequency range of interest e.g. speech and comparing it to threshold. In other implementations, outliers may be identified in other ways. The G.711 standard from the ITU (International Telecommunications Union), for example specifies an audio frequency range of 300 to 3400 Hz for pulse code modulation compression. In spoken conversations, there is very little audio energy outside that range. This or any other desired frequency range may be used for finding outliers. In embodiments, any signals outside that frequency range, or another selected range, may be considered to have no speech. In one example, the transfer function is the difference between the log of the beamformer PSD squared and the pair-wise noise estimate squared may be used. These differences may be summed over the relevant frequency range as indicated below:

$$\tau=\Sigma_{\omega\in\Omega}\ln|Y(\omega)|^2-\ln|P(\omega)|^2 \quad \text{Eq. 10}$$

The outliers may then be determined by using minimum and maximum thresholds. If τ is outside of the minimum and maximum, then the values may be ignored as follows:

$$\text{If } \tau\geq\tau_{max} \text{ or } \tau\leq\tau_{min}, \text{then skip current frame} \quad \text{Eq. 11}$$

The parameters for the range of $\tau_{min}$, and $\tau_{max}$ may be selected empirically from test data or in any other desired way.

When the transfer function is within the desired range, then a median transfer function ln $\overline{T}$ may be estimated based on the difference between the pair-wise noise and beamformer noise PSD using a per frame transfer function. The transfer function estimation 120 receives both the beamformer PSD and the pair-wise noise estimate PSD. If the frame is not an outlier, it may be assumed that the desired signal S=0, so Y=V.

$$\ln T = \ln|Y|^2 - \ln|P|^2 = \ln|V|^2 - \ln|P|^2 \quad \text{Eq. 12}$$

$$In\ \overline{T} = \ln \overline{T}_* + \alpha \operatorname{sign}(\ln T - \ln \overline{T}_*) \quad \text{Eq. 13}$$

Here $\overline{T}_*$ is a value of $\overline{T}$ on a previous frame. At 122, the noise PSD may be determined by combining the estimated transfer function with the pair-wise noise as follows:

$$|\overline{V}|^2 = \overline{T} \cdot |P|^2 \quad \text{Eq. 14}$$

The parameter for $\alpha$ may be selected empirically from test data or in any other desired way. The parameters affect the median adaptation speed. The parameters for $\alpha$ and $\tau$ may be selected to allow switching from spherical to cylindrical isotropy in 30-60 sec. In embodiments, the parameters are optimized beforehand for the best noise reduction for a particular system configuration and for expected uses. In some embodiments coordinate gradient descent is applied to a representative database of speech and noise samples. Such a database may be generated using typical types of users or a pre-existing source of speech samples may be used, such as TIDIGITS (from the Linguistic Data Consortium). The database may be extended by adding random segments of noise data to the speech samples.

As a result, there is now an audio PSD reference signal from the beamformer 114 and a noise PSD reference signal from the combiner 122. These are fed to a noise reduction component 124.

The noise reduction module may operate using the PSD signals in any of a variety of different ways. In one embodiment an Ephraim-Malah filter is used. In another embodiment, the PSD results for both the beamformer and the pair-wise noise estimation are applied to the noise reduction block to determine a Wiener filter gain G. This may be determined based on the difference in the PSD between the beamformer values and the noise estimates as follows:

$$G = \frac{\max\left(\epsilon, |\overline{Y}|^2 - |\overline{V}|^2\right)}{|\overline{Y}|^2} \quad \text{Eq. 15}$$

Negative outlier values of $|\overline{Y}|^2 - |\overline{V}|^2$ may be replaced by small $\in > 0$.

The noise reduction block produces a version of the audio reference signal PSD 134 for which the noise has been reduced. The output signal may be used for improving speech recognition in many different types of devices with microphone arrays including head-mounted wearable devices, mobile phones, tablets, ultra-books and notebooks. As described herein, a microphone array is used. Speech recognition is applied to the speech received by the microphones. The speech recognition applies post-filtering and beamforming to sampled speech. In addition to beamforming, the microphone array is used for estimating SNR (Signal to Noise Ratio) and post-filtering so that strong noise attenuation is provided.

The output audio PSD 134 may be applied to a speech recognition system or to a speech transmission system or both, depending on the particular implementation. For the command system, the output 134 may be applied directly to a speech recognition system 136. The recognized speech may then be applied to a command system 138 to determine a command or a request contained in the original speech from the microphones. The command may then be applied to a command execution system 140 such as a processor or transmission system. The command may be for local execution or the command may be sent to another device for execution remotely on the other device.

For a human interface, the output-log PSD may be combined with phase data 142 from the beamformer output 112 to convert the PSD 134 to speech 144 in a speech conversion system. This speech audio may then be transmitted or rendered in a transmission system 146. The speech may be rendered locally to a user or sent using a transmitter to another device, such as a conference or voice call terminal.

Figure 2:
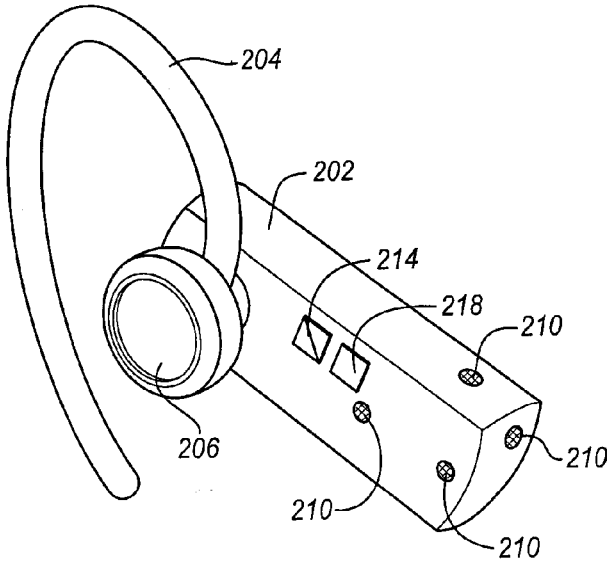
FIG. 2 is a diagram of a user device suitable for use with a speech enhancement system according to an embodiment.

FIG. 2 is a diagram of a user device in the form of a Bluetooth headset that may use noise reduction with multiple microphones for speech recognition and for communication with other users. The device has a frame or housing 202 that carries some or all of the components of the device. The frame carries an ear loop 204 to hang the device on a user's ear. A different type of attachment point may be used, if desired. Alternatively a clip or other fastener may be used to attach the device to a garment of the user.

The housing contains one or more speakers 206 near the user's ear to generate audio feedback to the user or to allow for telephone communication with another user. The housing may also be coupled to or include cameras, projectors, and indicator lights (not shown) all coupled to a system on a chip (SoC) 214. This system may include a processor, graphics processor, wireless communication system, audio and video processing systems, and memory, inter alia. The SoC may contain more or fewer modules and some of the system may be packaged as discrete system outside of the SoC. The audio processing described herein including noise reduction, speech recognition, and speech transmission systems may all be contained within the SoC or some of these components may be discrete components coupled to the SoC. The SoC is powered by a power supply 218 also incorporated into the device.

The device also has an array of microphones 210. In the present example, four microphones are shown arrayed across the housing. There may be more microphones on the opposite side of the housing (not shown). More or fewer microphones may be used depending on the particular implementation. The microphones may be coupled to a longer boom (not shown) and may be on different surfaces of the device in order to better use the beamsteering features described above. The microphone array may be coupled to the SoC directly or through audio processing circuits such as analog to digital converters, Fourier transform engines and other devices, depending on the implementation.

The user device may operate autonomously or be coupled to another device, such as a tablet or telephone using a wired or wireless link. The device may include additional control interfaces, such as switches and touch surfaces. The device may also receive and operate using voice commands. The coupled device may provide additional processing, display, antenna or other resources to the device. Alternatively, the microphone array may be incorporated into a different device such as a tablet or telephone or stationary computer and display depending on the particular implementation.

Figure 3:
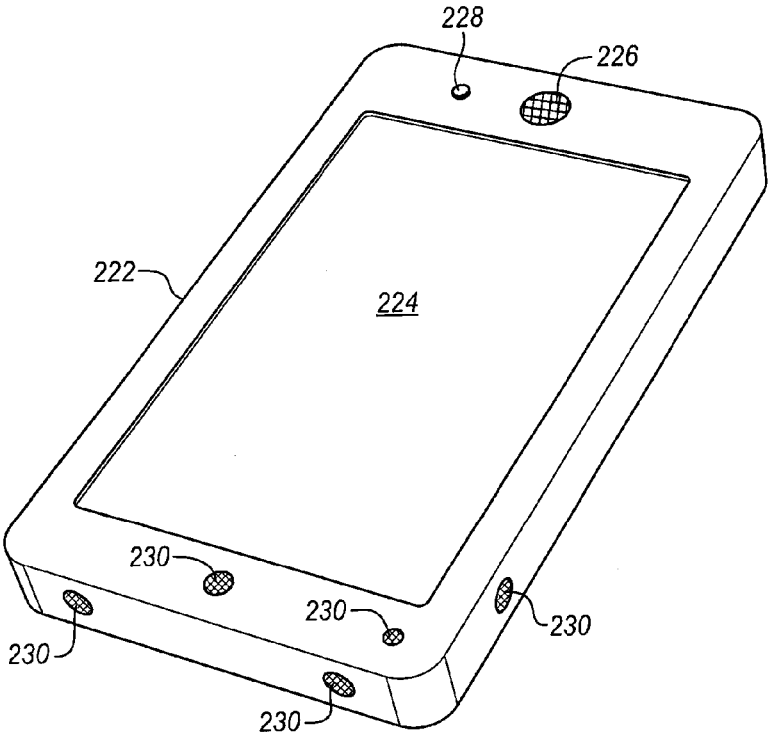
FIG. 3 is a diagram of an alternative user device suitable for use with a speech enhancement system according to an embodiment.

FIG. 3 is a diagram of a user computing device in the form of a cellular telephone that may use noise reduction with multiple microphones for speech recognition and for communication with other users. The device has a frame or housing 222 that carries some or all of the components of the device. The frame carries a touch screen 224 to receive user input and present results. Additional buttons and other surfaces may be provided depending on the implementation.

The housing contains one or more speakers 226 near the user's ear to generate audio feedback to the user or to allow for telephone communication with another user. One or more cameras 228 provide for video communication and recording. The touch screen, cameras, speakers and any physical buttons are all coupled to an internal system on a chip (SoC) (not shown). This system may include a processor, graphics processor, wireless communication system, audio and video processing systems, and memory, inter alia. The SoC may contain more or fewer modules and some of the system may be packaged as a discrete system outside of the SoC. The audio processing described herein including noise reduction, speech recognition, and speech transmission systems may all be contained within the SoC or some of these components may be discrete components coupled to the SoC. The SoC is powered by an internal power supply (not shown) also incorporated into the device.

The device also has an array of microphones 230. In the present example, five microphones are shown arrayed across the bottom of the device on several different orthogonal surfaces. There may be more microphones on the opposite side of the device to receive background and environmental sounds. More or fewer microphones may be used depending on the particular implementation. The microphone array may be coupled to the SoC directly or through audio processing circuits such as analog to digital converters, Fourier transform engines and other devices, depending on the implementation.

The user device may operate autonomously or be coupled to the Bluetooth headset or another device using a wired or wireless link. The coupled device may provide additional processing, display, antenna or other resources to the device. Alternatively, the microphone array may be incorporated into a different device such as a tablet or telephone or stationary computer and display depending on the particular implementation.

Figure 4:
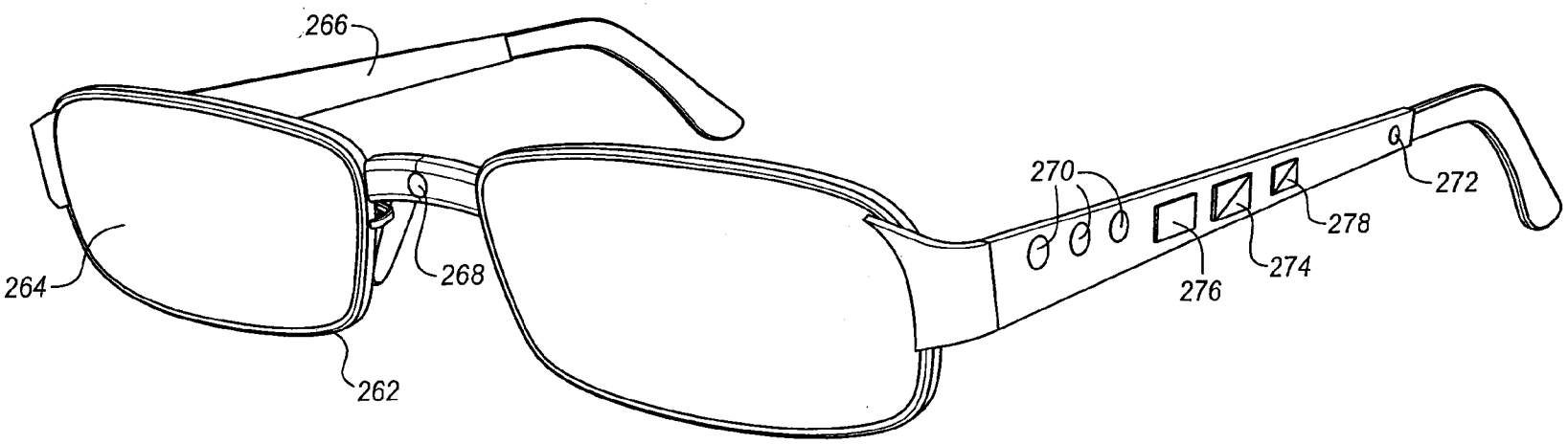
FIG. 4 is a diagram of another alternative user device suitable for use with a speech enhancement system according to an embodiment.

FIG. 4 is a diagram of a user device in the form of headwear, eyewear, or eyeglasses that may use noise reduction with multiple microphones for speech recognition and for communication with other users. The device has a frame or housing 262 that carries some or all of the components of the device. The frame may alternatively be in the form of goggles, a helmet, or another type of headwear or eyewear. The frame carries lenses 264 one for each of the user's eyes. The lenses may be used as a projection surface to project information as text or images in front of the user. A projector 276 receives graphics, text, or other data and projects this onto the lens. There may be one or two projectors depending on the particular implementation.

The user device also includes one or more cameras 268 to observe the environment surrounding the user. In the illustrated example there is a single front camera. However, there may be multiple front cameras for depth imaging, side cameras and rear cameras.

The system also has a temple 266 on each side of the frame to hold the device against a user's ears. A bridge of the frame holds the device on the user's nose. The temples carry one or more speakers 272 near the user's ears to generate audio feedback to the user or to allow for telephone communication with another user. The cameras, projectors, and speakers are all coupled to a system on a chip (SoC) 274. This system may include a processor, graphics processor, wireless communication system, audio and video processing systems, and memory, inter alia. The SoC may contain more or fewer modules and some of the system may be packaged as discrete dies or packages outside of the SoC. The audio processing described herein including noise reduction, speech recognition, and speech transmission systems may all be contained within the SoC or some of these components may be discrete components coupled to the SoC. The SoC is powered by a power supply 278, such as a battery, also incorporated into the device.

The device also has an array of microphones 270. In the present example, three microphones are shown arrayed across a temple 266. There may be three more microphones on the opposite temple (not visible) and additional microphones in other locations. The microphones may instead all be in different locations than that shown. More or fewer microphones may be used depending on the particular implementation. The microphone array may be coupled to the SoC directly or through audio processing circuits such as analog to digital converters, Fourier transform engines and other devices, depending on the implementation.

The user device may operate autonomously or be coupled to another device, such as a tablet or telephone using a wired or wireless link. The coupled device may provide additional processing, display, antenna or other resources to the device. Alternatively, the microphone array may be incorporated into a different device such as a tablet or telephone or stationary computer and display depending on the particular implementation.

Figure 5:
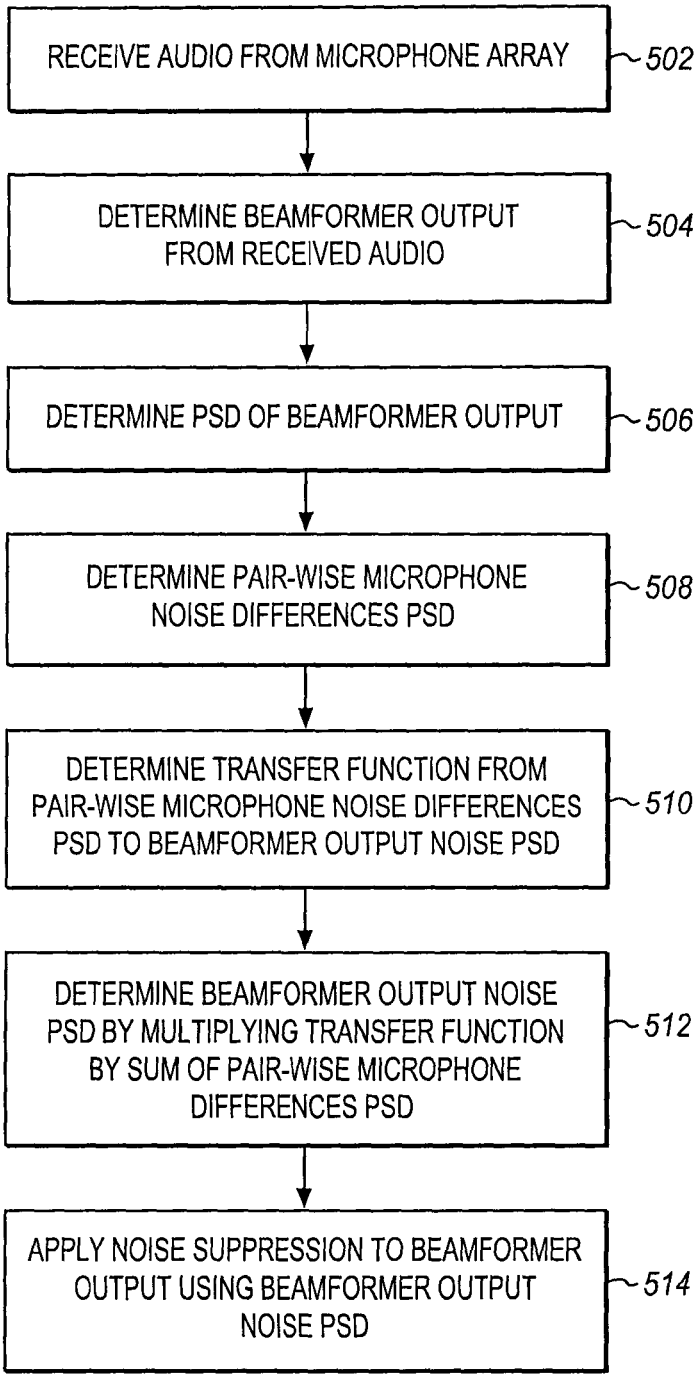
FIG. 5 is a process flow diagram of enhancing speech according to an embodiment.

FIG. 5 is a simplified process flow diagram of the basic operations performed by the system of FIG. 1. This method of filtering audio from a microphone array may have more or fewer operations. Each of the illustrated operations may include many additional operations, depending on the particular implementation. The operations may be performed in a single audio processor or central processor or the operations may be distributed to multiple different hardware or processing devices.

The process of FIG. 5 is a continuous process that is performed on the sequence of audio samples as the sample are received. For each cycle the process begins at 502 with receiving audio from the microphone array. As mentioned above, the array may have two microphones or many more microphones.

At 504 a beamformer output is determined from the received audio. As described above, the received audio may be converted to short term Fourier transform audio frames. The beamformer output may be determined by then taking a weighted sum of each converted frame over each microphone.

At 506 a power spectral density is determined from the beamformer output. At 508 a pair-wise microphone power spectral density noise differences are determined. This may be done in any of a variety of different ways such as by taking a difference between the audio received from a pairing of each microphone with each other microphone of the array of microphones for each sample frequency and summing the differences.

At 510 a transfer function is determined from the two PSD determinations. The transfer function is a transfer function between the pair-wise noise power spectral density differences and the beamformer output noise power spectral density. The transfer function may be determined by summing differences between a log of the beamformer output power spectral density and a log of the pair-wise microphone power spectral density over frequencies that are likely to contain primarily the desired audio. These differences may be applied by estimating a running median of logarithms of per-frame transfer functions.

At 512 the transfer function is multiplied by a sum of the pair-wise microphone power spectral density differences. This is used to determine a beamformer output noise power spectral. This may be done by applying the transfer function to the pair-wise noise power spectral density differences. For greater accuracy audio frames are selected for use in determining beamformer output PSD. The selected audio frames correspond to a pair-wise microphone power spectral density noise difference that is less than a selected threshold. In addition audio frames may be used that are not within a frequency range for speech.

At 514 the noise PSD is applied to the beamformer output PSD to produce a PSD output of the received audio with reduced noise. This output may be used for many different tasks. As an example, speech recognition may be applied to the power spectral density output to recognize a statement in the received audio. As another example, the PSD output may be combined with phase data to generate an audio signal containing speech with reduced noise.

Figure 6:
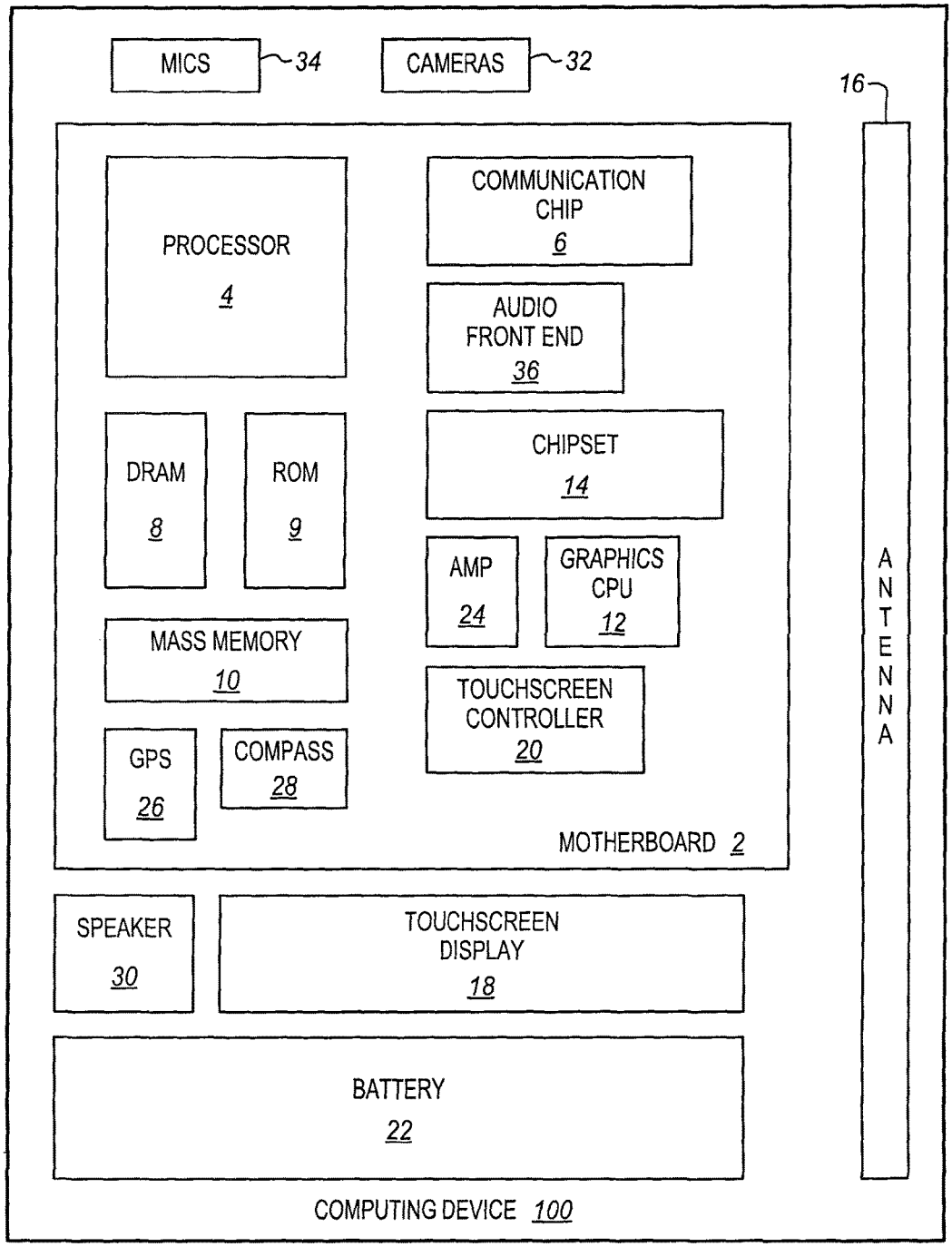
FIG. 6 is a block diagram of a computing device incorporating speech enhancement according to an embodiment.

FIG. 6 is a block diagram of a computing device 100 in accordance with one implementation. The computing device 100 houses a system board 2. The board 2 may include a number of components, including but not limited to a processor 4 and at least one communication package 6. The communication package is coupled to one or more antennas 16. The processor 4 is physically and electrically coupled to the board 2.

Depending on its applications, computing device 100 may include other components that may or may not be physically and electrically coupled to the board 2. These other components include, but are not limited to, volatile memory (e.g., DRAM) 8, non-volatile memory (e.g., ROM) 9, flash memory (not shown), a graphics processor 12, a digital signal processor (not shown), a crypto processor (not shown), a chipset 14, an antenna 16, a display 18 such as a touchscreen display, a touchscreen controller 20, a battery 22, an audio codec (not shown), a video codec (not shown), a power amplifier 24, a global positioning system (GPS) device 26, a compass 28, an accelerometer (not shown), a gyroscope (not shown), a speaker 30, a camera 32, a microphone array 34, and a mass storage device (such as hard disk drive) 10, compact disk (CD) (not shown), digital versatile disk (DVD) (not shown), and so forth). These components may be connected to the system board 2, mounted to the system board, or combined with any of the other components.

The communication package 6 enables wireless and/or wired communications for the transfer of data to and from the computing device 100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication package 6 may implement any of a number of wireless or wired standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, Ethernet derivatives thereof, as well as any other wireless and wired protocols that are designated as 3G, 4G, 5G, and beyond. The computing device 100 may include a plurality of communication packages 6. For instance, a first communication package 6 may be dedicated to shorter range wireless communications such as Wi-Fi and Bluetooth and a second communication package 6 may be dedicated to longer range wireless communications such as GPS, EDGE, GPRS, CDMA, WiMAX, LTE, Ev-DO, and others.

The microphones 34 and the speaker 30 are coupled to an audio front end 36 to perform digital conversion, coding and decoding, and noise reduction as described herein. The processor 4 is coupled to the audio front end to drive the process with interrupts, set parameters, and control operations of the audio front end. Frame-based audio processing may be performed in the audio front end or in the communication package 6.

In various implementations, the computing device 100 may be eyewear, a laptop, a netbook, a notebook, an ultrabook, a smartphone, a tablet, a personal digital assistant (PDA), an ultra mobile PC, a mobile phone, a desktop computer, a server, a set-top box, an entertainment control unit, a digital camera, a portable music player, or a digital video recorder. The computing device may be fixed, portable, or wearable. In further implementations, the computing device 100 may be any other electronic device that processes data.

Embodiments may be implemented as a part of one or more memory chips, controllers, CPUs (Central Processing Unit), microchips or integrated circuits interconnected using a motherboard, an application specific integrated circuit (ASIC), and/or a field programmable gate array (FPGA).

References to "one embodiment", "an embodiment", "example embodiment", "various embodiments", etc., indicate that the embodiment(s) so described may include particular features, structures, or characteristics, but not every embodiment necessarily includes the particular features, structures, or characteristics. Further, some embodiments may have some, all, or none of the features described for other embodiments.

In the following description and claims, the term "coupled" along with its derivatives, may be used. "Coupled" is used to indicate that two or more elements co-operate or interact with each other, but they may or may not have intervening physical or electrical components between them.

As used in the claims, unless otherwise specified, the use of the ordinal adjectives "first", "second", "third", etc., to describe a common element, merely indicate that different instances of like elements are being referred to, and are not intended to imply that the elements so described must be in a given sequence, either temporally, spatially, in ranking, or in any other manner.

The drawings and the forgoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

The following examples pertain to further embodiments. The various features of the different embodiments may be variously combined with some features included and others excluded to suit a variety of different applications. Some embodiments pertain to a method that includes receiving audio from a plurality of microphones, determining a beamformer output from the received audio, determining a power spectral density of the beamformer output, determining pair-wise microphone power spectral density noise differences, multiplying a transfer function by a sum of the pair-wise microphone power spectral density differences, determining a noise power spectral density using the transfer function multiplication, and applying the noise power spectral density to the beamformer output power spectral density to produce a power spectral density output of the received audio with reduced noise.

In further embodiments the transfer function is determined by estimating a running median of logarithms of per-frame transfer functions.

In further embodiments wherein the transfer function is a transfer function between the pair-wise noise power spectral density differences and the beamformer output noise power spectral density.

Further embodiments include determining the transfer function by summing differences between a log of the beamformer output power spectral density and a log of the pair-wise microphone power spectral density over frequencies that are likely to contain primarily the desired audio.

In further embodiments determining the noise power spectral density comprises applying the transfer function to the pair-wise noise power spectral density differences.

In further embodiments determining pair-wise microphone power spectral density noise differences comprises taking a difference between the audio received from a pairing of each microphone with each other microphone of the array of microphones for each sample frequency and summing the differences.

In further embodiments determining a beamformer output comprises converting the received audio to short term Fourier transform audio frames and taking a weighted sum of each frame over each microphone.

In further embodiments determining a noise power spectral density further comprises selecting audio frames for use in the determining that correspond to a pair-wise microphone power spectral density noise difference that is less than a selected threshold.

In further embodiments determining a noise power spectral density further comprises selecting audio frames for use in the determining that are not within a frequency range for speech.

Further embodiments include applying speech recognition to the power spectral density output to recognize a statement in the received audio.

Further embodiments include combining the power spectral density output with phase data to generate an audio signal containing speech with reduced noise.

Some embodiments pertain to a machine-readable medium having instructions stored thereon that, when operated on by the machine, cause the machine to perform operations that include receiving audio from a plurality of microphones, determining a beamformer output from the received audio, determining a power spectral density of the beamformer output, determining pair-wise microphone power spectral density noise differences, multiplying a transfer function by a sum of the pair-wise microphone power spectral density differences, determining a noise power spectral density using the transfer function multiplication, and applying the noise power spectral density to the beamformer output power spectral density to produce a power spectral density output of the received audio with reduced noise.

In further embodiments the transfer function is a transfer function between the pair-wise noise power spectral density differences and the beamformer output noise power spectral density.

Further embodiments include determining the transfer function by summing differences between a log of the beamformer output power spectral density and a log of the pair-wise microphone power spectral density over frequencies that are likely to contain primarily the desired audio.

In further embodiments determining a noise power spectral density further comprises selecting audio frames for use in the determining that correspond to a pair-wise microphone power spectral density noise difference that is less than a selected threshold.

In further embodiments determining a noise power spectral density further comprises selecting audio frames for use in the determining that are not within a frequency range for speech.

Some embodiments relate to an apparatus that includes a microphone array and a noise filtering system to receive audio from a plurality of microphones, determine a beamformer output from the received audio, determine a power spectral density of the beamformer output, determine pair-wise microphone power spectral density noise differences, multiply a transfer function by a sum of the pair-wise microphone power spectral density differences, determine a noise power spectral density using the transfer function multiplication, and apply the noise power spectral density to the beamformer output power spectral density to produce a power spectral density output of the received audio with reduced noise.

In further embodiments the transfer function is determined by estimating a running median of logarithms of per-frame transfer functions.

In further embodiments the transfer function is a transfer function between the pair-wise noise power spectral density differences and the beamformer output noise power spectral density.

Further embodiments include a housing configured to be worn by the user and wherein the microphone array and the noise filtering system are carried in the housing.

The invention claimed is:

1. A method of filtering audio from a microphone array comprising:

receiving audio from a plurality of microphones;

determining a beamformer output from the received audio;

determining a power spectral density of the beamformer output;

determining pair-wise microphone power spectral density noise differences;

multiplying a transfer function by a sum of the pair-wise microphone power spectral density differences;

determining a noise power spectral density using the transfer function multiplication; and using the noise power spectral density to modify the beamformer output power spectral density to produce a power spectral density output of the received audio with reduced noise.

2. The method of claim 1, wherein the transfer function is determined by estimating a running median of logarithms of per-frame transfer functions.

3. The method of claim 1, wherein the transfer function is a transfer function between the pair-wise noise power spectral density differences and the beamformer output noise power spectral density.

4. The method of claim 1, further comprising determining the transfer function by summing differences between a log of the beamformer output power spectral density and a log of the pair-wise microphone power spectral density over frequencies that are likely to contain primarily the desired audio.

5. The method of claim 4, wherein determining the noise power spectral density comprises applying the transfer function to the pair-wise noise power spectral density differences.

6. The method of claim 1, wherein determining pair-wise microphone power spectral density noise differences comprises taking a difference between the audio received from a pairing of each microphone with each other microphone of the array of microphones for each sample frequency and summing the differences.

7. The method of claim 1, wherein determining a beamformer output comprises converting the received audio to short term Fourier transform audio frames and taking a weighted sum of each frame over each microphone.

8. The method of claim 1, wherein determining a noise power spectral density further comprises selecting audio frames for use in the determining that correspond to a pair-wise microphone power spectral density noise difference that is less than a selected threshold.

9. The method of claim 1, wherein determining a noise power spectral density further comprises selecting audio frames for use in the determining that are not within a frequency range for speech.

10. The method of claim 1, further comprising applying speech recognition to the power spectral density output to recognize a statement in the received audio.

11. The method of claim 1, further comprising combining the power spectral density output with phase data to generate an audio signal containing speech with reduced noise.

12. A non-transitory machine-readable medium having instructions stored thereon that, when operated on by the machine, cause the machine to perform operations comprising:

receiving audio from a plurality of microphones;

determining a beamformer output from the received audio;

determining a power spectral density of the beamformer output;

determining pair-wise microphone power spectral density noise differences;

multiplying a transfer function by a sum of the pair-wise microphone power spectral density differences;

determining a noise power spectral density using the transfer function multiplication; and using the noise power spectral density to modify the beamformer output power spectral density to produce a power spectral density output of the received audio with reduced noise.

13. The medium of claim 12, wherein the transfer function is a transfer function between the pair-wise noise power spectral density differences and the beamformer output noise power spectral density.

14. The medium of claim 12, the operations further comprising determining the transfer function by summing differences between a log of the beamformer output power spectral density and a log of the pair-wise microphone power spectral density over frequencies that are likely to contain primarily the desired audio.

15. The medium of claim 12, wherein determining a noise power spectral density further comprises selecting audio frames for use in the determining that correspond to a pair-wise microphone power spectral density noise difference that is less than a selected threshold.

16. The medium of claim 12, wherein determining a noise power spectral density further comprises selecting audio frames for use in the determining that are not within a frequency range for speech.

17. An apparatus comprising:

a microphone array; and a noise filtering system to receive audio from a plurality of microphones, determine a beamformer output from the received audio, determine a power spectral density of the beamformer output, determine pair-wise microphone power spectral density noise differences, multiply a transfer function by a sum of the pair-wise microphone power spectral density differences, determine a noise power spectral density using the transfer function multiplication, and use the noise power spectral density to modify the beamformer output power spectral density to produce a power spectral density output of the received audio with reduced noise.

18. The apparatus of claim 17, wherein the transfer function is determined by estimating a running median of logarithms of per-frame transfer functions.

19. The apparatus of claim 17, wherein the transfer function is a transfer function between the pair-wise noise power spectral density differences and the beamformer output noise power spectral density.

20. The apparatus of claim 17, further comprising a housing configured to be worn by the user and wherein the microphone array and the noise filtering system are carried in the housing.

* * * * *